US005692634A

United States Patent [19]

Jenkins et al.

[11] Patent Number: 5,692,634

[45] Date of Patent: Dec. 2, 1997

[54] RIGID PACKAGING USING GAS-PERMEABLE MEMBRANE

[75] Inventors: Leonard A. Jenkins, Pittsburgh, Pa.; William H. Dalrymple, Weirton, W. Va.

[73] Assignee: Weirton Steel Corporation, Weirton, W. Va.

[21] Appl. No.: 479,769

[22] Filed: Jun. 7, 1995

Related U.S. Application Data

[63] Continuation-in-part of Ser. No. 155,511, Nov. 22, 1993, Pat. No. 5,590,558, and a continuation-in-part of Ser. No. 421,777, Apr. 14, 1995, Pat. No. 5,626,049.

[51] Int. Cl.[6] ..... B65D 51/18

[52] U.S. Cl. ..... 220/256; 220/257; 220/258; 220/276; 220/371; 220/373; 426/106; 426/115; 426/395; 426/397; 215/261; 206/508; 206/509

[58] Field of Search ..... 220/4.27, 256, 220/257, 258, 276, 288, 308, 371, 373; 426/106, 115, 118, 395, 397; 215/261; 206/508, 509

[56] References Cited

U.S. PATENT DOCUMENTS

| | | | |
|---|---|---|---|
| 3,409,160 | 11/1968 | Scott | 426/118 X |
| 4,842,875 | 6/1989 | Anderson | 426/118 |
| 4,966,780 | 10/1990 | Hargraves et al. | 426/118 |
| 5,045,331 | 9/1991 | Antoon, Jr. | 426/118 |
| 5,322,701 | 6/1994 | Cullen et al. | 426/124 |
| 5,344,662 | 9/1994 | Payne et al. | 426/124 |
| 5,515,994 | 5/1996 | Goglio | 220/372 |

*Primary Examiner*—Stephen Cronin
*Attorney, Agent, or Firm*—Shanley and Baker

[57] ABSTRACT

Rigid container structure for hermetic sealing of particulate solids which emit an off-gas during containment. Provisions are made for enclosing chamber space with a gas-permeable imperforate membrane film so as to selectively separate and retain an off-gas out of contact with container contents. In a specific embodiment, carbon dioxide is selectively separated from coffee contents while the entire container, including such enclosed chamber as established, is hermetically sealed from ambient atmosphere. Provision is also made for venting of a separated off-gas in initiating a rupture of an end closure structure prior to full opening of the container. That arrangement further diminishes the opportunity for inadvertent discharge of particulate solids due to expulsion of gas from inert gas purging and from gas emitted during hermetic sealing.

21 Claims, 10 Drawing Sheets

RIGID PACKAGING USING GAS-PERMEABLE MEMBRANE

RELATED APPLICATIONS

This application is a continuation in part of co-owned U.S. application Ser. No. 08/155,511, filed Nov. 22, 1993, now U.S. Pat. No. 5,590,558; and is a continuation in part of co-owned U.S. application Ser. No. 08/421,777, filed Apr. 14, 1995, now U.S. Pat. No. 5,626,049.

INTRODUCTION

This invention relates to packaging of particulate solids which emit an off-gas during containment; and, more particularly, is concerned with new rigid container structures and packaging procedures for maintaining a selected hermetic sealing integrity while eliminating or significantly diminishing contact of an emitted off-gas with container contents.

SUMMARY OF THE INVENTION

The present invention selectively separates an off-gas, such as carbon dioxide, from container contents while the entire container remains hermetically sealed from ambient atmosphere. An added contribution is automatic venting of separated off-gas upon initiation of a preliminary opening step. A resulting advantage is avoidance of expulsion of particulate contents due to implosion of ambient atmosphere; also, internal gas pressure from inert gas packing of contents is diminished by such selective separation of emitted off-gas, as is significant interference by the emitted off-gas with container contents.

Other advantages and contributions of the invention are set forth in more detail in describing embodiments of the invention shown in the accompanying drawings.

DETAILED DESCRIPTION OF THE INVENTION

Coffee beans are blended for roasting for purposes of achieving a desired flavor and aroma in the end product used by the consumer. However, after grinding, coffee loses those desired features and its freshness in a relatively short time when not in a hermetically-sealed container. In addition, significant amounts of carbon dioxide are emitted by ground coffee during storage which dilute volatile aromatic constituents from the coffee. Objectives of the invention are to help maintain desired features of container contents and to help sustain freshness during hermetically-sealed packaging. The invention teaches new, efficient and economic packaging concepts for helping to achieve those objectives by providing for selectively separating an emitted off-gas from container contents while maintaining such an emitted off-gas within the hermetically-sealed container.

In a specific embodiment, volatile constituents of coffee, which contribute to its aroma, are not diluted with excessive carbon dioxide during hermetically-sealed storage, and the volatile aromatic constituents stay in contact with coffee contents. Upon opening, the emitted carbon dioxide is either held in a separated compartment or vented separately to ambient atmosphere.

Rigid container features for achieving the above objectives and advantages are described in relation to FIGS. 1–9, in which off-gases are selectively separated by selection of molecular sieve characteristics for an imperforate gas-permeable membrane film. And provisions for selection of packaging procedures to meet differing packaging line requirements are described in relation to FIGS. 10 and 11.

The concepts for improving hermetic sealing conditions and meeting various package line requirements, as taught herein, involve (a) fixed placement of such gas-permeable membrane film in a manner so as to avoid or minimize interference by the film (i) with packaging procedures, (ii) with storage of container contents, or (iii) with subsequent use of container contents; (b) positioning the gas-permeable film (i) so as to establish an enclosed chamber for receiving and holding an emitted gas during hermetic sealing, (ii) so as to eliminate or diminish contact of such off-gas with container contents, or (iii) so as to automatically vent such off-gas to ambient atmosphere before access to container contents.

Figure 1:
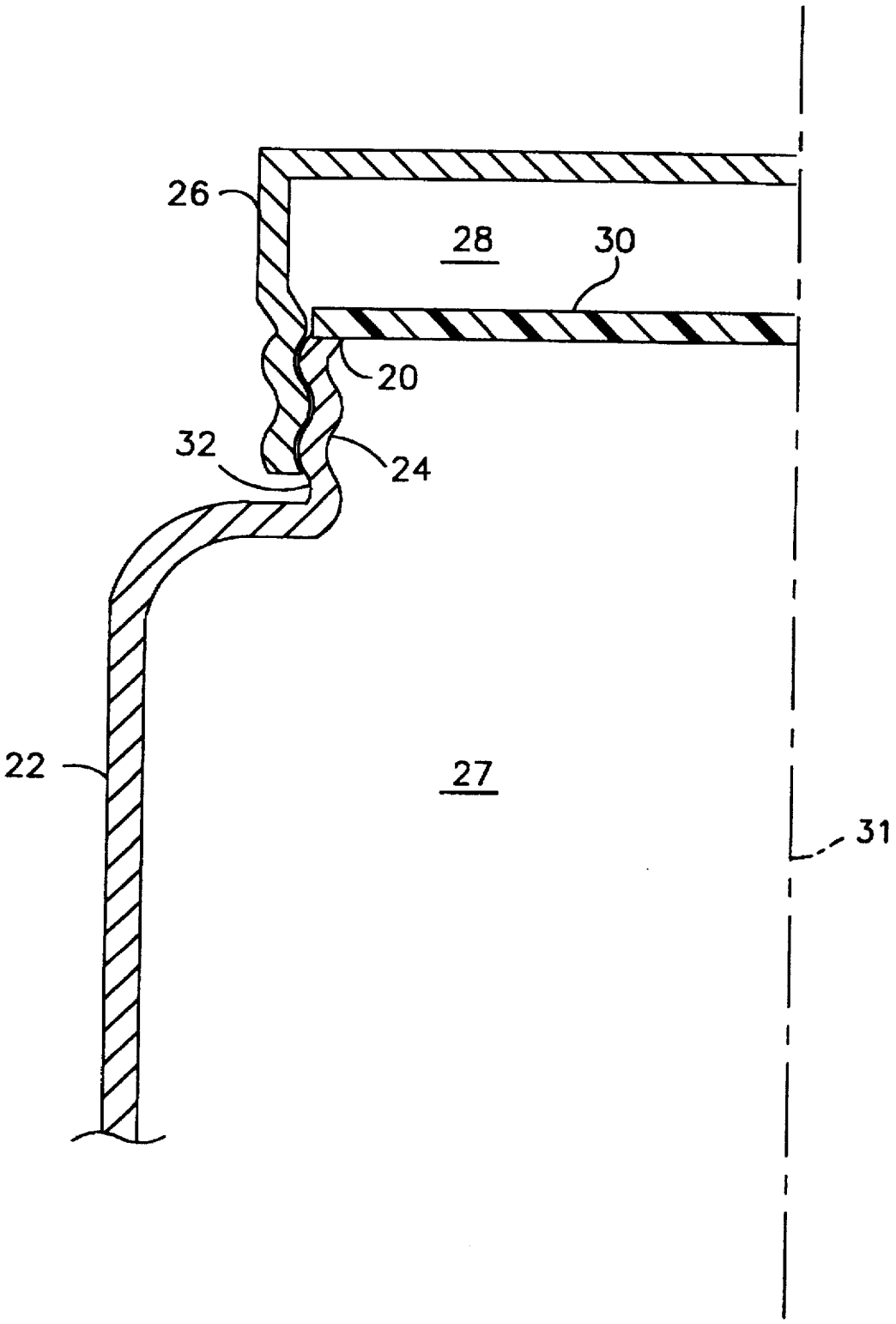
FIG. 1 is a schematic cross-sectional partial view for describing features made possible with threaded end closure teachings of the invention.

In FIG. 1, a portion of the side wall, in approaching open longitudinal end 20 of container side wall 22, is necked-in to provide a configuration of lesser transverse area than the remainder of the side wall. Also in FIG. 1, that necked-in portion is fabricated so as to present threads 24 for receiving a screw cap end closure structure 26. Container contents during storage are indicated at 27.

Space for separating gas is defined in part by the screw cap closure structure 26. That space is formed into enclosed chamber 28 by an imperforate membrane film 30 which is selectively gas-permeable. The membrane film 30 is fixedly positioned in transverse relationship to the centrally-located axis 31 of the open end 20 of container body 22. Such imperforate membrane is preferentially permeable to an emitted off-gas, such as carbon dioxide ($CO_2$) as emitted by coffee and certain other dry comestibles.

Rigid packaging materials, which are impervious to ambient atmosphere and capable of withstanding either vacuum or inert gas purging pressure levels, are selected for hermetic sealing purposes. Provision is made for differing pressure levels to be selected for differing components of the container. Also, as described later, when using flat-rolled sheet metal, either longitudinal end of an elongated container can be utilized for completing hermetic sealing during closure of a container.

Emission of off-gases by contents 27 of a hermetically-sealed container establishes, or adds to, a pressure differential across membrane 30 during storage. That pressure differential can be augmented by use of inert gas pressure purging of container contents 27, while a space for an enclosed chamber can be established at a lower pressure prior to completing hermetic sealing of the container.

Figure 2:
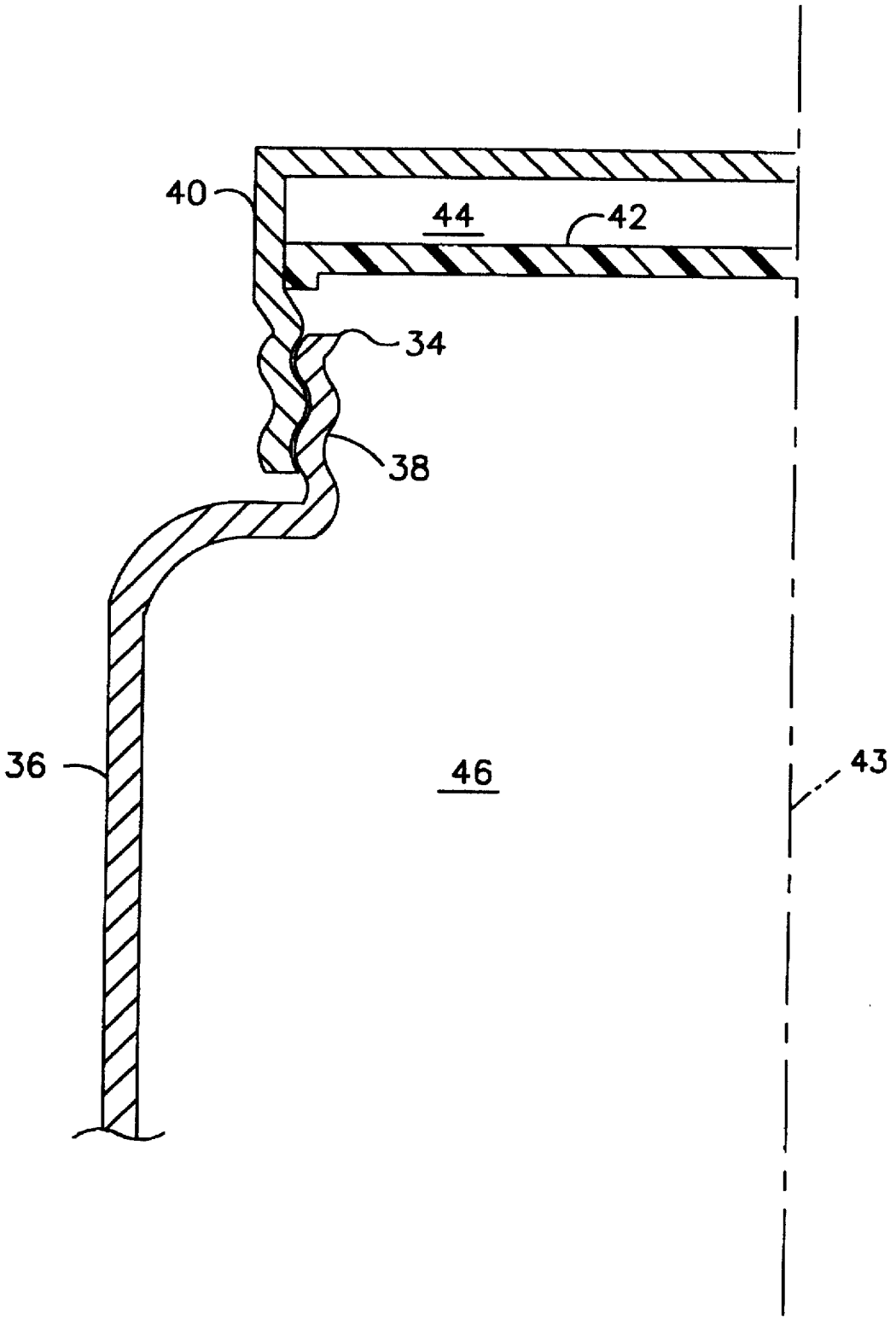
FIG. 2 is a schematic cross-sectional partial view for describing added features of another threaded end closure embodiment of the invention.

Establishing an off-gas separation chamber, completely within the screw cap or other closure structure, more readily facilitates independent choices for hermetic sealing procedures. Referring to FIG. 2, a portion of the side wall near open longitudinal end 34 of container body 36 is necked-in and presents threads 38 for receiving screw cap 40. A gas-permeable imperforate membrane film 42 is made integral in a fixed position within the screw cap 40. Film 42 is fixed, e.g. adhesively, around the interior circumferential periphery of cap 40 in transverse relationship to centrally-located axis 43. Enclosed chamber 44 of FIG. 2 is established independently of the container body. Enclosed chamber 44 is positioned to receive, and is capable of storing, an emitted gas such as carbon dioxide, which passes through gas-permeable film 42. Such gas is held in chamber 44 out of contact with container contents 46.

The types of end closure structures and container body structures taught herein enable selection of which longitudinal end of an elongated container is closed last in order to complete hermetic sealing, and that selection is increased by use of a flat-rolled sheet metal container body. Increasing those selections also increases packaging line options. Forming a separated enclosed chamber, such as 44 within closure cap 40 of FIG. 2, also facilitates selection of pressure differentials within the container. For example, chamber 44 can advantageously and independently be established at a lower pressure level than that of container body 36 prior to hermetic sealing of the container. Also, hermetic sealing can then be completed at the opposite end by providing flat-rolled sheet metal can body side wall with flange metal for double-seamed joinder with flange metal of a flat-rolled sheet metal endwall, forming a three-piece can.

Selecting a pressure level for an enclosed chamber independently of the container body pressure level can also be readily practiced with the end closures described in relation to FIGS. 3 through 5 and a later-described embodiment. Packaging with chime-seam end closure features enables use of either a one-piece or a two-piece (with side wall seam) sheet metal can body and increases the size range of can bodies which can be used with established packaging equipment. Hermetic sealing, using double-seam joinder of flange metal of a can body to flange metal of an end closure, is described in more detail later and enables hermetic sealing from either longitudinal end of a can fabricated from rigid flat-rolled sheet metal.

Figure 3:
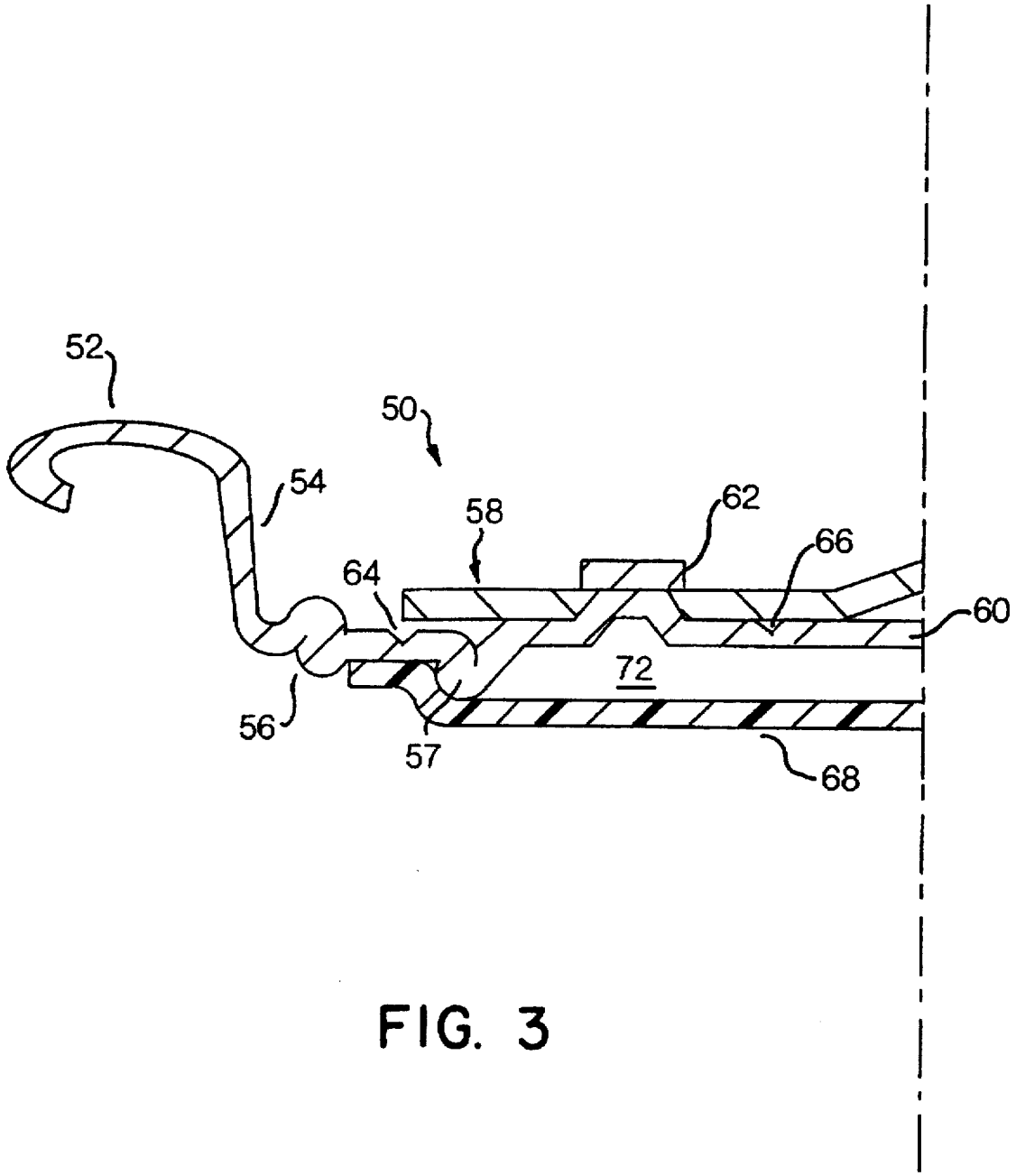
FIG. 3 is a cross-sectional partial view for describing features made available with an easy-open double-seaming end closure embodiment of the invention.
Figure 4:
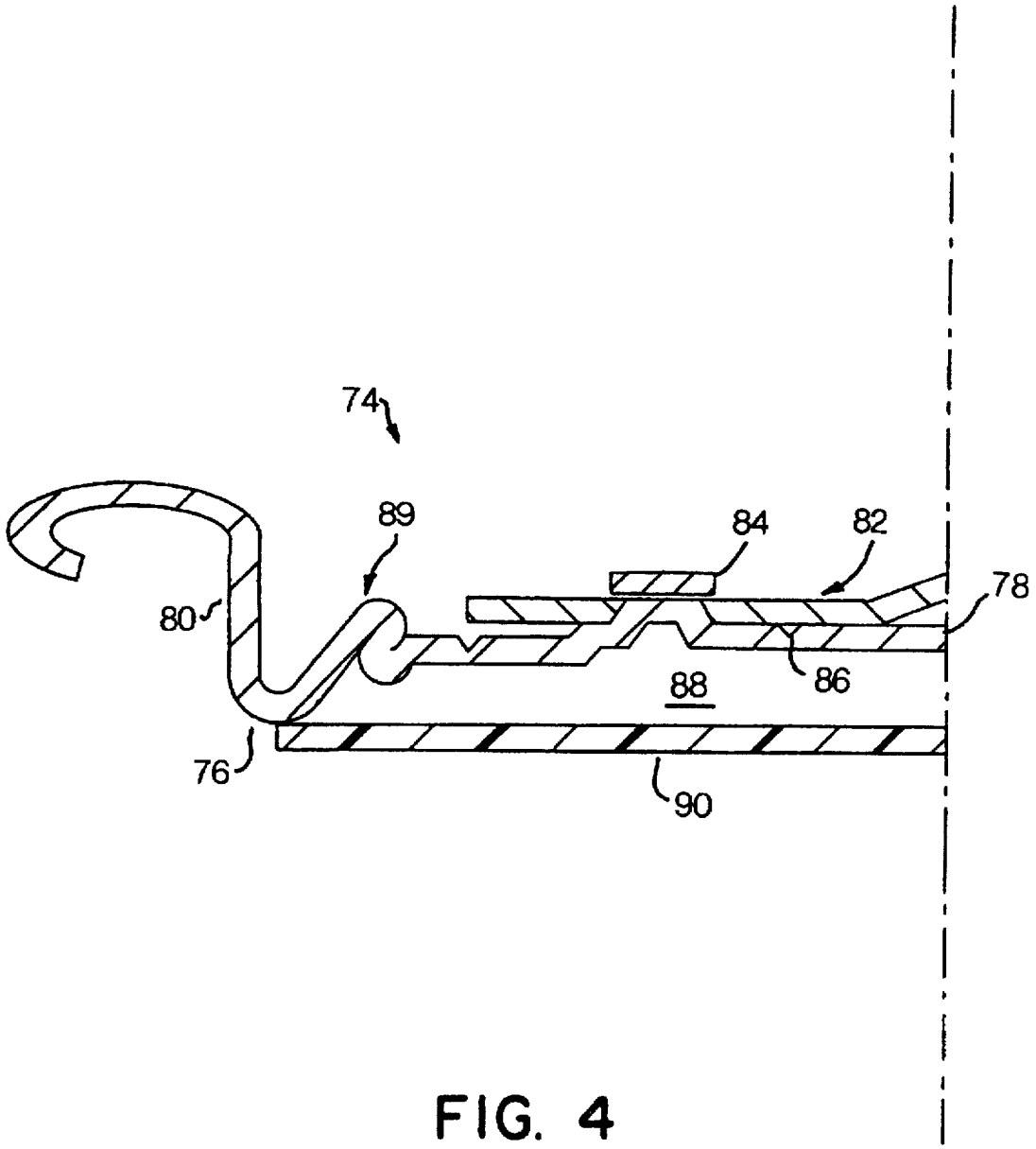
FIG. 4 is a cross-sectional partial view for describing added features of another easy-open end closure embodiment of the invention.
Figure 5:
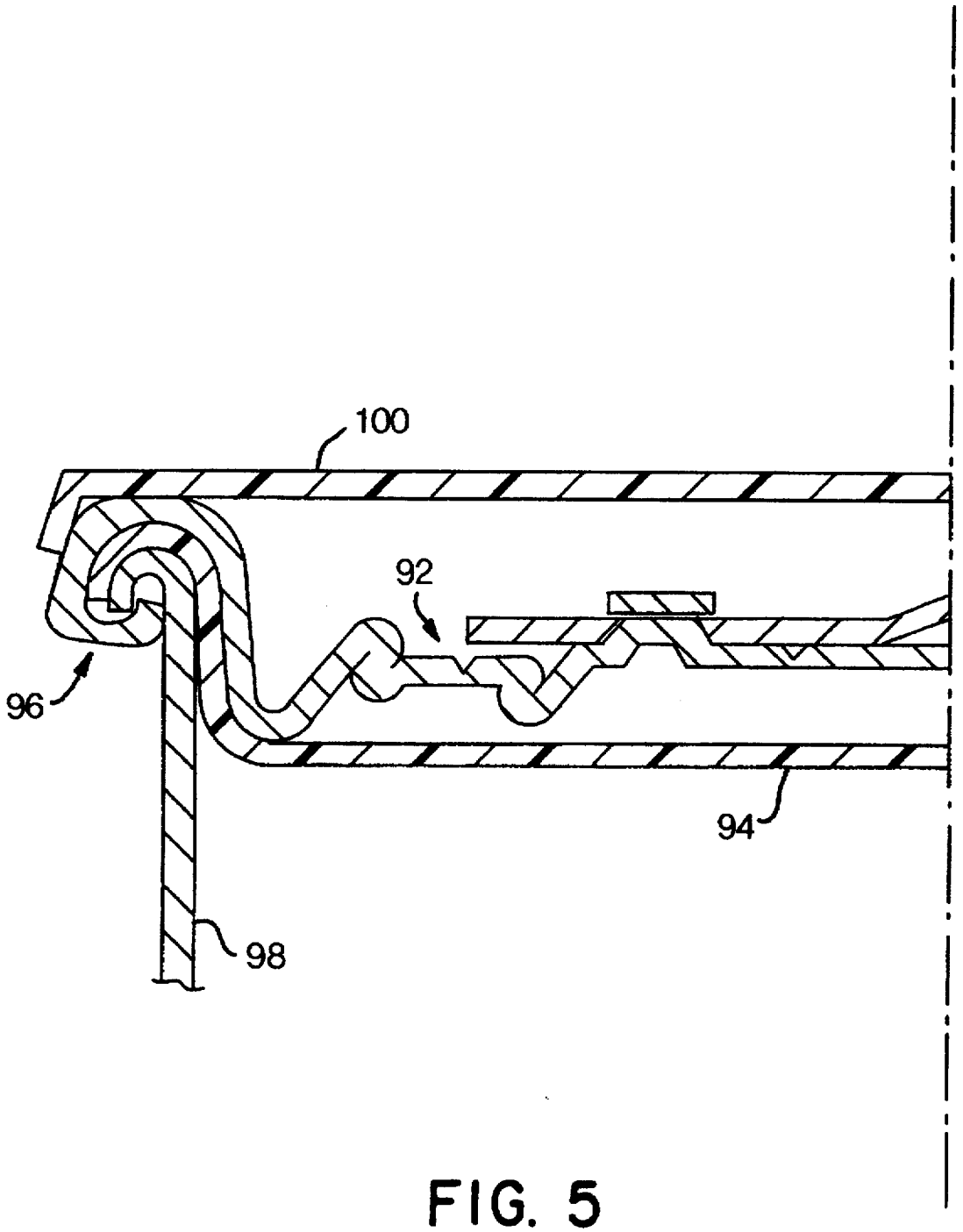
FIG. 5 is a cross-sectional partial view for membrane placement describing a sealing concept of the invention and a cover for use with selected embodiments.

In the embodiments of FIGS. 3 through 5, the off-gas emitted by container contents is separately stored and is vented automatically by rupturing a special scoreline which initiates convenience-feature opening. The off-gas is thus vented automatically in a manner which is independent of container contents; and, also, in a manner which helps to avoid loss of particulate coffee. That is, a portion of container pressure is vented before any access to container contents.

In FIG. 3, easy-open end closure structure 50 includes flange metal 52, chime metal 54, and multi-layer sheet metal folds 56, 57. The latter sheet metal folds are located to provide consumer protection from the raw edge remaining with the can body and from that remaining with a separated endwall panel, respectively (as described in more detail in U.S. Pat. No. 4,804,106 to William T. Saunders assigned to the owner of the present application and incorporated herein by reference). An opener 58 is secured to endwall panel 60 by unitary rivet 62. More specifically, flange 52, chime 54, protective folds 56, 57, endwall panel 60 and rivet 62 comprise unitary sheet metal. A peripheral scoreline 64 for endwall panel 60 is located intermediate multi-layer folds 56, 57. The previously-mentioned special scoreline comprises back scoreline 66, which is contiguous to rivet 62 and at least partially circumscribes rivet 62.

As rupture of back scoreline 66 is initiated, automatic venting of off-gas is provided. That occurs upon initial lifting of the handle end (not shown) of opener 58. Continued rupturing of sheet metal of back scoreline 66, as described in more detail in above-incorporated U.S. Pat. No. 4,804,106, enables the handle end of opener 58 to pivot about rivet 62 toward a position which provides for rupturing of peripheral scoreline 64 at the working end of opener 58.

The initial rupture of back scoreline 66 automatically vents a coffee off-gas, such as carbon dioxide, as separated by carbon dioxide-permeable membrane film 68. Prior to initiating back scoreline rupture, the separated carbon dioxide is held in chamber 72, which is defined by the internal surface of endwall closure structure 50 and membrane 68 of FIG. 3. Such planned venting of an off-gas occurs prior to any rupture of peripheral scoreline 64. In the embodiment of FIG. 3, rupture of scoreline 64 breaks the contiguous membrane film 68.

Expulsion of particulate coffee or premature volatile release of aromatic constituents is thus avoided by automatic venting of carbon dioxide to ambient atmosphere. The embodiment of FIG. 3 has the added advantage of severing and removing a major end panel portion of gas-permeable membrane 68, which occur as convenience feature severing proceeds along the periphery of endwall panel 60 to provide full panel access to container contents.

In FIG. 3, the imperforate gas-permeable film 68 contacts the area between multi-layer folds 56, 57. Film 68 is joined to that area by an organic polymeric adhesive material, such as an epoxy. The structural features of various embodiments of the invention enable selective pressure level placement of an imperforate gas-permeable membrane. For example, at a vacuum level or at a pressure level which is lower than inert gas purge pressure used during hermetic sealing of the container.

Elongated sheet metal can body embodiments of the invention facilitate selection of vacuum and/or purge pressure level conditions from either longitudinal end for completing hermetic sealing. Establishing an enclosed gas separating chamber, as part of an end closure structure, facilitates hermetic sealing of container at an inert gas purging pressure level while the gas separating chamber of the end closure structure is established at a lower pressure level.

The container body and end closure structure of a completed container are formed from rigid material which is impervious to ambient atmosphere and capable of withstanding hermetic vacuum sealing or hermetic sealing using inert gas purging pressure. Flat-rolled steel, having a nominal gauge selected between about fifty-five to about one hundred ten pounds per base box, provides for selection of desired strength for various coffee can sizes. Necked-in longitudinal end can bodies increase the range of coffee can sizes available for convenience opening and one-piece can body features. A surface coating of the flat-rolled steel substrate with, for example, Chrome-chrome oxide followed by an organic polymeric coating, provides for production of one-piece can bodies which are ready for use, as fabricated, in accordance with copending U.S. application Ser. No. 08/421,777, which is assigned to the owner of the present application and is included herein by reference.

Selection from easy-open endwall closure embodiments, operating as disclosed, enables off-gas to be readily vented separately from container contents without interfering with coffee aroma, packaging rate, or consumer usage of the rigid can body after opening; the latter is due to the edge protection provided. A plastic overcap, as shown in FIG. 5, is used after removal of an easy-open endwall panel of the embodiments of FIGS. 3, 4 and 5, and with a later-described embodiment.

The easy-open end closure structure 74 of FIG. 4 (as described in U.S. Pat. No. 5,038,956 to William T. Saunders, assigned to the owner of the present application) includes a shock absorbing countersunk bead 76. As shown, bead 76 is located about the periphery of endwall panel 78 contiguous to chime wall 80. That location is used to help define a chamber for receiving and sealing the gas-permeable membrane. An integral opener 82 operates about unitary rivet 84, in the manner described in relation to FIG. 3, to sever back scoreline 86. Imperforate membrane film 90 extends across the interior of end closure structure to the peripherally-located countersunk bead 76, thus enclosing chamber 88 which, because of bead 76, has a greater capacity than the enclosed chamber 72 of FIG. 3.

In the embodiment of FIG. 4, triple-fold protector 89 is provided on the portion of the end closure 74 which remains with the can body. Folded sheet metal edge protection has optionally been omitted on the severed endwall panel 78, as shown in FIG. 4. Film 90 is attached about the full periphery of bead 76, preferably by an organic polymeric adhesive. The film panel of FIG. 4 remains with the can body after severance of sheet metal end panel 78. Film 90 can then be severed separately, after removal of sheet metal endwall panel 78.

The easy-open end closure structure 92 of FIG. 5 uses a countersunk peripheral bead to help define the capacity of an emitted gas separating chamber. However, in FIG. 5, gas-permeable membrane 94 extends into double-seam 96, which is formed by flange metal of the end closure structure 92 and flange metal of the can body 98. The periphery of the gas-permeable membrane 94 is held within the double-seam 96 as such seam is formed. Plastic overcap 100 of FIG. 5 is held by the easy-open end prior to opening and, after removal of the peripherally-scored endwall panel, the overcap is used as a cover for the can body while the contents are being used.

Forming an elongated container body with a unitary bottom wall configuration 101, such as that shown in FIG. 6, has certain advantages when located longitudinally opposite to the end closure embodiment, later described in relation to FIGS. 8, 9. That is, the unitary endwall of FIG. 6 inherently provides a bottom wall configuration which indicates that the other end is to be opened first, and which inherently does not permit accidental opening of a bottom wall using a conventional rotor-wheel can opener.

Figure 6:
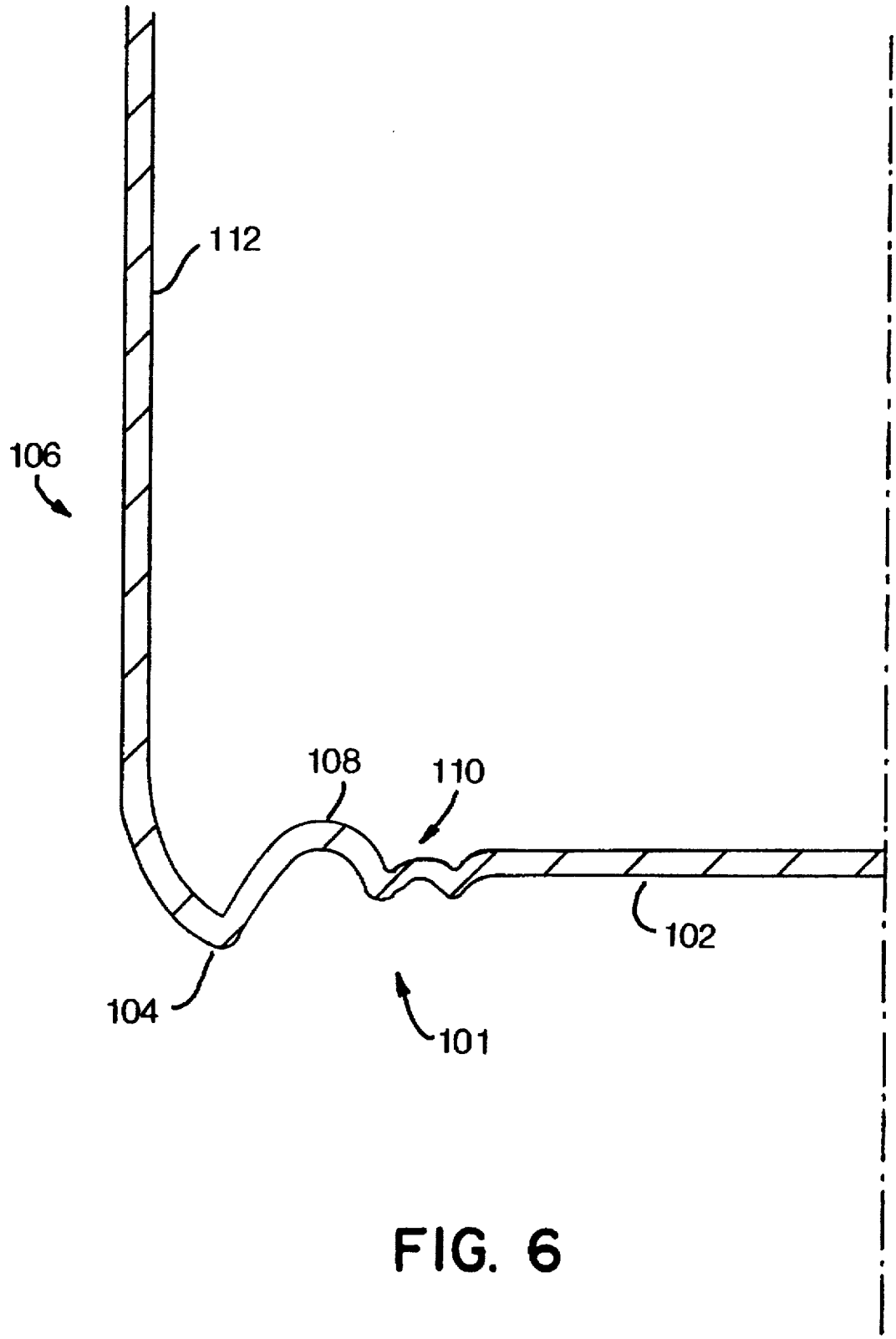
FIG. 6 is a schematic cross-sectional partial view for describing unitary bottom wall features made available for use with the invention.

The unitary bottom wall configuration 101 of FIG. 6 provides for large capacity coffee cans. The necked-in open end configurations are established to interfit, for stable stacking purposes, within the unitary bottom wall configuration shown. That bottom wall configuration is defined in part with a recessed bead such as 108. That novel stacking feature for large coffee can embodiments of the invention has distinct advantages for handling, packing and shelf display purposes.

Figure 8:
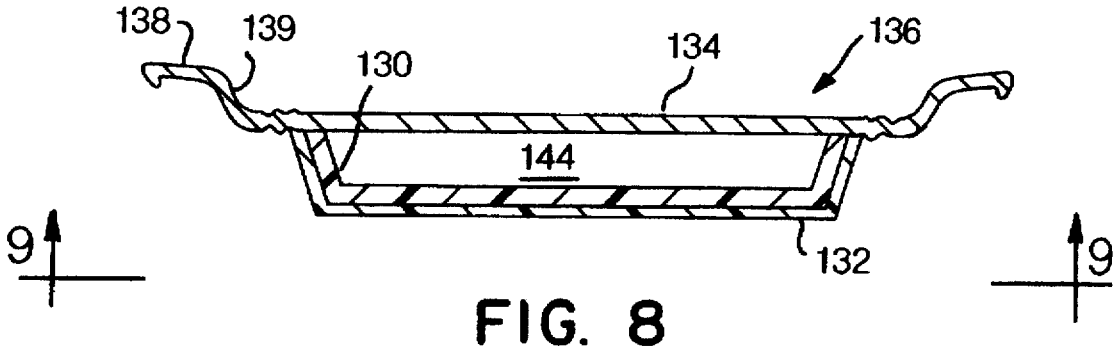
FIG. 8 is a schematic cross-sectional view for describing selective-size, chamber-forming features of an embodiment of the invention.
Figure 9:
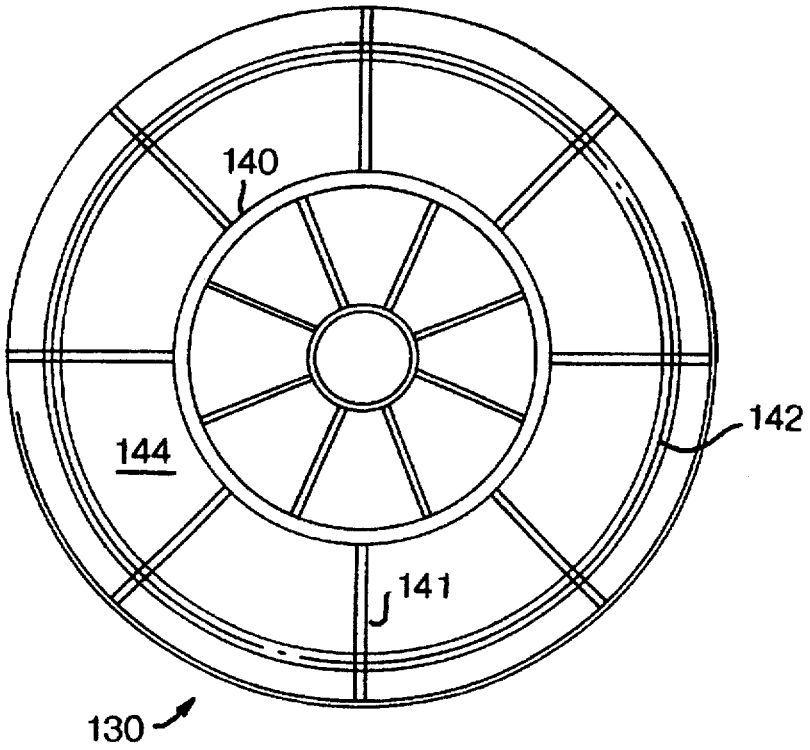
FIG. 9 is a schematic plan view, taken along 9—9 of the end closure depicted in FIG. 8.

In a preferred packaging procedure of the invention, hermetic sealing would be completed using the screw cap embodiments of FIGS. 1 and 2, or using double-seam flange sealing of the easy-open embodiments of FIGS. 3 through 5, or using the supported compartment double-seam embodiment of FIGS. 8, 9; each such embodiment presenting a unitary bottom wall configuration with characteristics described in relation to FIG. 6.

Details of draw forming practice to provide a one-piece sheet metal can body with unitary bottom wall are disclosed in the copending and co-owned patent application Ser. No. 08/421,777, as set forth above. A recessed panel 102 and bottom wall configuration of the type shown in FIG. 6 can be formed as part of completing final side wall diameter forming. Annular rim 104 at the distal bottom end of can body 106 provides stable support. An inwardly recessed bead 108, along with curved configuration (as shown in cross section) profiling portions 110, provide for recessing of panel 102 and also facilitate flexing of endwall panel 102 inwardly or outwardly, depending on whether the container is under vacuum or pressure, respectively. The necked-in open end side wall, as described, enables use of a slightly smaller-diameter closure structure at the upper end of the can body for the embodiments of FIGS. 3 through 5 and that of FIGS. 8, 9 such that display shelf stacking provides substantially uninterrupted side wall product identification. A reduced-diameter version of the type of overcap shown in FIG. 5 enables nested stacking features not previously available with the relatively large capacity cans often preferred for ground coffee.

Figure 7:
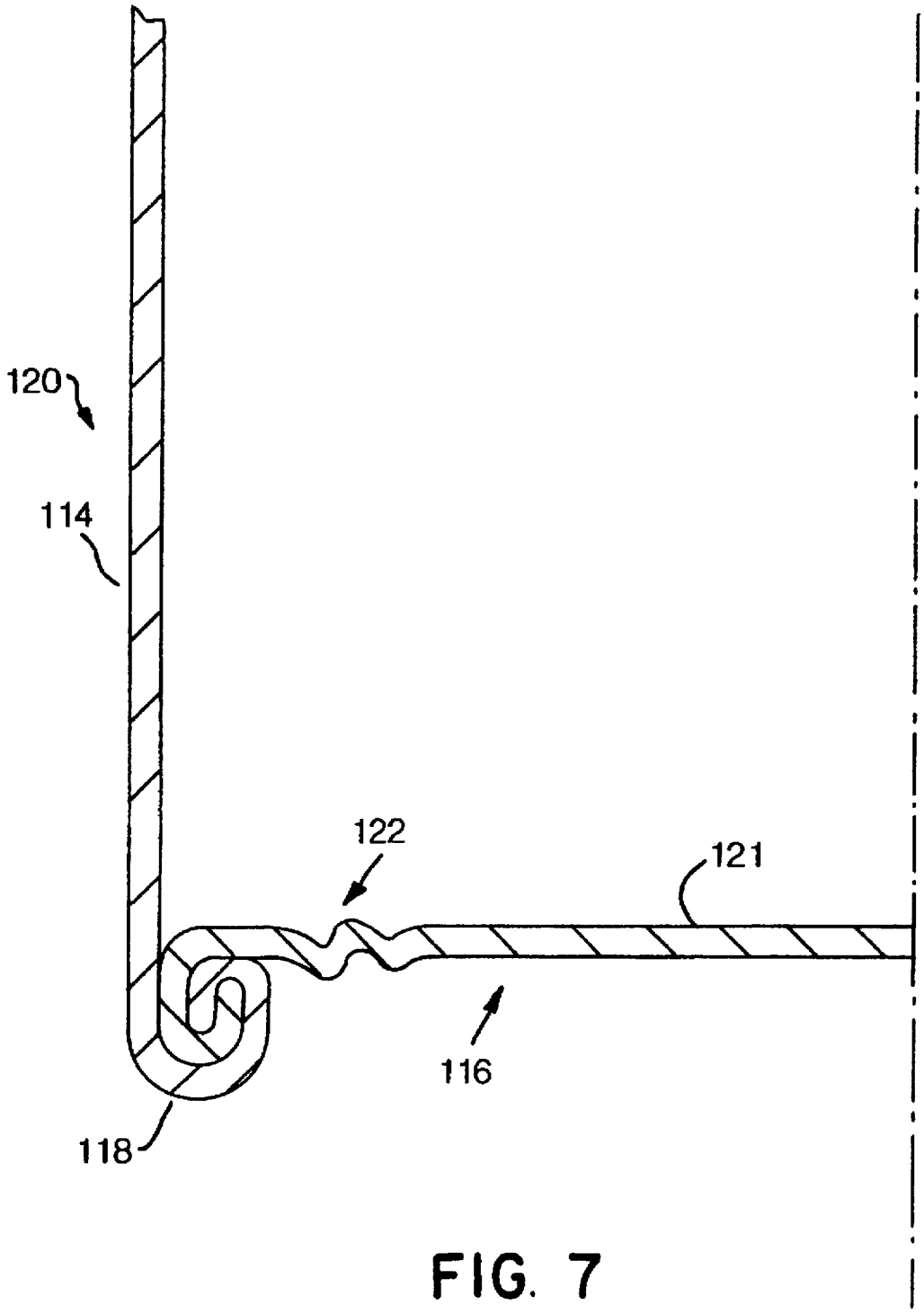
FIG. 7 is a schematic cross-sectional partial view for describing double-seaming endwall features made available for use with the invention.

Double-seam joinder of a profiled bottom wall panel, as shown in FIG. 7, extends those features of the invention to canmaking facilities limited to three-piece cans and to canning lines which are dependent on double-seaming at a bottom wall location in order to complete hermetic sealing. Use of a double-seam end closure structure at each end of the central axis enables use of large-diameter, side-seam welded can bodies which can take advantage of the double-seams described in relation to FIG. 7, and the enclosed framework support described later in relation to FIGS. 8, 9. A side-seamed three-piece can finds special utility with the embodiments of FIGS. 1 through 5, since a threaded cap or an easy-open end closure structure readily indicates to a consumer that such end is to be opened first.

In FIG. 7, flange metal from side wall 114 and flange metal from endwall structure 116 are combined to form double-seam 118. A double-seam bottom wall enables the various screw cap embodiments to complete hermetic sealing at the bottom wall where required by a packaging line layout. Such double-seam bottom wall differs only in bottom configuration, as described later.

Endwall 116 includes a circular configuration panel 121 (in plan view of FIG. 7) and contiguous rippled profiling 122 (as shown in cross-section). The rippled profiling enables endwall panel 121 to flex inwardly or outwardly, depending upon internal vacuum or pressure, respectively.

The chime wall depth for an endwall panel, such as 121 or the configuration of the double-seam 118 of FIG. 7, is modified when used in an embodiment which does not readily indicate, as FIGS. 1 through 5 indicate, which longitudinal end should be opened first. For example, modification to the bottom configuration, such as increasing the radial width of the double-seam, prevents accidental opening of the bottom endwall using a conventional roller-knife opener. Such an accidental bottom endwall opening could diminish the advantages provided by separation of emitted carbon dioxide during storage. Aromatic constituents of coffee, for example, are not diluted or diminished in function by the carbon dioxide.

An internal lattice-structure support configuration is provided for the embodiment of FIGS. 8 and 9. Member 130 supports an imperforate gas-permeable film 132. The lattice-type framework and supported gas-permeable film are affixed to the interior (product side) surface of endwall panel 134 of end closure structure 136 for a container body. End closure structure 136 in this embodiment is preferably fabricated from flat-rolled steel, with flange metal 138 being unitary with chime metal 139 and endwall panel 134. The latter can be provided to facilitate flexing of a central portion as described in relation to FIG. 7.

The lattice-type framework, for providing a shape-support member such as 130, is fabricated by known molding practice, using organic polymeric materials acceptable to the U.S. Food and Drug Administration for packaging comestibles. Framework member 140 (FIG. 9) is supported axially in spaced relationship from panel 134 by projecting legs 141 which extend toward the larger-base member ring 142. In FIGS. 8, 9, centralized member 140 is circular, in plan view, with legs 141 extending readily outwardly to a ring-shaped base. Base ring 142 fits within, and is secured about, the periphery of endwall panel 134. The framework of member 130 provides lattice-like support without significantly decreasing the surface area available for imperforate gas-permeable membrane film 132. Disposing the film on the exterior of the lattice-type framework; that is, toward the product contents, provides a preferred type of support for the membrane film when inert gas pressurized purging is used for hermetic sealing of contents. The imperforate membrane film 132, which is permeable to carbon dioxide in a coffee can embodiment, covers the lattice support structure 130 and is secured to endwall structure 136. Chamber 144 is defined by the inner surface of endwall panel 134 and by the configuration selected for supporting membrane film 132. The configuration and size of the supporting framework are adapted to the size and contents of the can body on which used.

Carbon dioxide emitted by the ground coffee permeates the film 132 and is held in the enclosed chamber 144. Preferably, the attachment of support framework 130 to the product-side surface of endwall panel 134 and the covering with membrane film 132 are made under conditions such that chamber 144 is at a lower pressure than that of container-held contents. Both chamber 144 and the container contents are hermetically-sealed within the container. Film 132 is selected to be permeable to an undesirable off-gas, such as carbon dioxide; that off-gas is held in hollow chamber 144 effectively decreasing or preventing commingling, in the case of coffee, with aromatic constituents during extended storage of ground coffee.

The flat-rolled steel end closure 136 is joined, using flange metal 138 of the end closure and flange metal at the open end of a can body, to form a double-seam of the type described in relation to FIG. 7. The lattice-type support structure provides for selection of storage volume for an emitted off-gas by selection of the size and configuration of the lattice support member 130; and such framework selection can be adapted to use on an end closure structure for a necked-in can body side wall.

Figure 10:
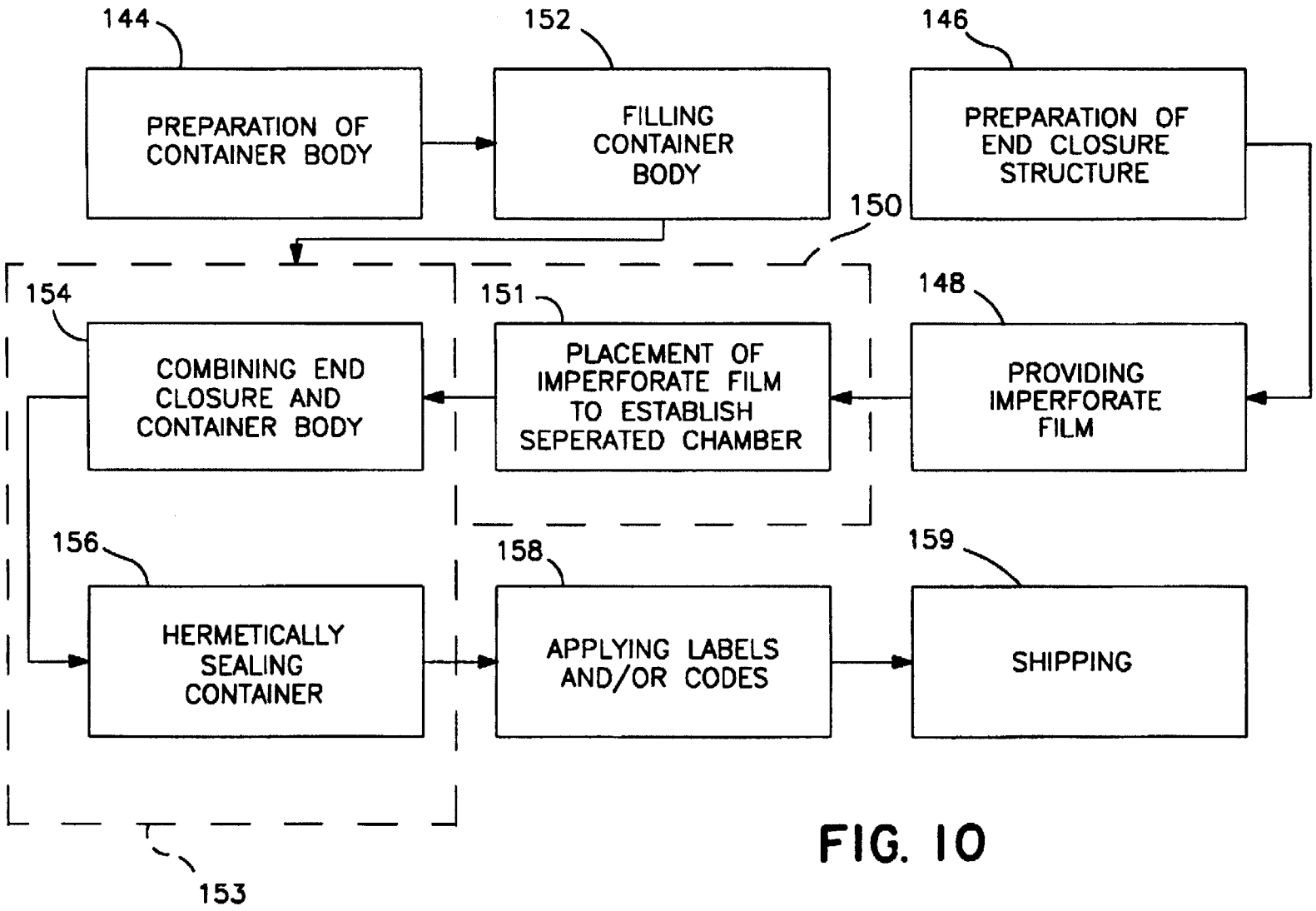
FIGS. 10 and 11 are box diagram general arrangement views for describing packaging procedures made available by the invention.

Packaging concepts and procedures of the invention, described in relation to FIG. 10, refer to particular embodiments in which an imperforate gas-permeable film membrane is made an integral part of an end closure structure, such as the screw cap of FIG. 2 or the end closure structures of FIGS. 3 through 5, and 8, 9.

Referring to the box diagram general arrangement of FIG. 10, preliminary steps, such as fabricating a can body (at 144) and an end closure structure (at 146), can be carried out in advance of filling and packaging line procedures. An imperforate gas-permeable film is provided at 148 for subsequent combination with an end closure at a preselected pressure level. The pressure level can be selected in the space defined by interrupted line 150 for carrying out joinder of the gas-permeable membrane film with the end closure structure at 151.

An enclosed chamber for emitted gas is thus formed as an integral part of the end closure structure for the processing procedures of FIG. 10; and a differing pressure level can be selected for hermetic sealing. Filling of the can body at ambient atmospheric pressure can be carried out separately at 152. With the hermetic sealing pressure level being selected within the space outlined by interrupted line 153. Combining the closure structure (which includes an enclosed chamber) with the can body 154 takes place with hermetic sealing of the container being completed at 156. A selected vacuum level or an inert gas purging level is provided within the space indicated by interrupted line 153. The subsequent labeling at 158 and packing for shipping at 159 can be independent of pressure level gas indicated.

Figure 11:
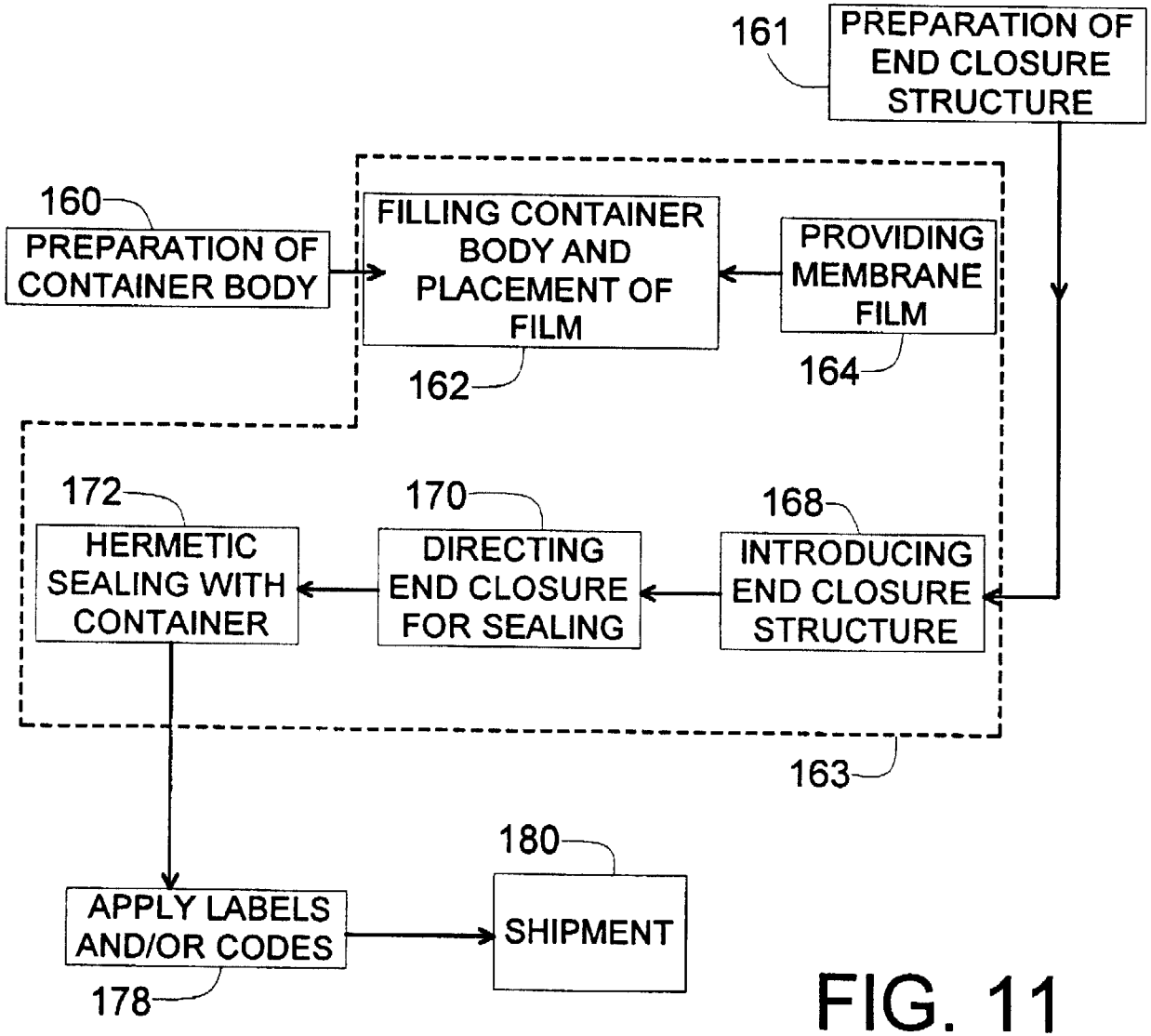

Other packaging options and procedures are described in relation to schematic box diagram general arrangement of FIG. 11, and are particularly adapted to an embodiment in which a membrane film is fixedly attached across the cross section of a container body. In such an embodiment, when container contents are added from what will be the upper end of a container, such as the screw cap end of FIG. 1, the hermetic sealing pressure level within the container body 22 and within space 28 are substantially the same in practice. That pressure level can be selected at a vacuum level or at an inert gas purge pressure level for hermetic sealing.

Referring to FIG. 11, a can body is fabricated at 160 and an end closure prepared at 161; the can body and end closure can be fabricated in advance of packaging line processing. The can body provided at 160 is filled at 162 with contents, such as coffee. Filling of the can body can be carried out at ambient atmospheric pressure, or can be carried out at a selected hermetic sealing pressure level as maintained within a space defined by interrupted line 163. An imperforate membrane film, permeable to carbon dioxide when canning coffee, is provided at 164. The container contents are under vacuum or inert gas purge pressure as the film is placed across the open end of the can body at 162. Such placement of the membrane film on the can body is carried out, at the level of pressure selected for hermetic sealing, within the space indicated by interrupted line 163. An end closure structure, as prepared at 161, is introduced to such preselected pressure level space at 168 and is directed at 170 for hermetic sealing with the filled container body. The selected level for hermetic sealing is maintained within the space defined by interrupted line 163 for filling of the container body, for placement of gas-permeable membrane in transverse relationship to the central axis of the container body, and for placement of the end closure structure which helps to define an enclosed space for accumulating an off-gas.

For example, the membrane film provided at 164 is placed over the open end of the filled container body at 162.

Completing hermetic sealing with a threaded end closure is carried out at 172. The can body and the enclosed chamber for an emitted gas are at a hermetic sealing level, vacuum or inert gas purge pressure as selected within the space defined by interrupted line 163. The container structure can be labeled as necessary at 178 and prepared for shipment at 180 (FIG. 11) at ambient atmospheric pressure.

Specific configurations, arrangements, materials and processing steps have been set forth for purposes of describing the invention. However, it should be recognized that changes in those specifics can, in the light of above teachings, be selected by those skilled in the art while continuing to rely on the novel concepts described. Therefore, in determining the scope of the present invention, reference shall be made to the accompanying claims.

We claim:

1. Rigid container which provides for selective separation of an off-gas emitted from container contents, while maintaining hermetic sealing integrity of such contents and the separated off-gas prior to opening of the container, comprising (A) container body means formed from rigid material which is impervious to ambient atmosphere, consisting essentially of flat-rolled sheet metal, capable of withstanding levels of pressure selected from the group consisting of vacuum purging and inert gas purging, such container body means:

(i) defining an elongated centrally-located axis for such container, (ii) having a side wall symmetrically disposed in relation to such centrally-located axis, and (iii) a closed bottom wall at one longitudinal end of such axis;

(B) end closure means for positioning at the remaining longitudinal end of the centrally-located axis, in transverse relationship to such axis, such end closure means being formed from a rigid material impervious to ambient atmosphere so as to be capable, in combination with such container body means, of hermetic sealing of container contents;

(C) chamber space, partially defined by a portion of such container, and by (D) an imperforate membrane film, which is permeable to an emitted off-gas selected for separation, with the imperforate membrane film being positioned at a fixed location, in transverse relationship to such centrally-located axis between container contents and such end closure means establishing an enclosed chamber for receiving and retaining such off-gas selected for separation, while such container contents and enclosed chamber are hermetically sealed within such container.

2. The rigid container of claim 1, in which such container body means comprises an elongated side wall having a main body portion, a unitary bottom wall configuration at one longitudinal end of such side wall and a longitudinally opposite open end, with a portion of such side wall contiguous to such open end of such elongated side wall being necked-in to a smaller transverse cross sectional area than such main body portion of such side wall, and, in which such gas-permeable membrane film establishes such enclosed chamber by selection from the group consisting of (a) placement of such film as an integral part of, and contiguous to, such necked-in open end of such container body, and (b) placement of such film as an integral part of such end closure means in confronting relationship with such container contents.

3. The rigid container of claim 1, in which such container body means comprises an elongated sheet metal side wall and unitary endwall configuration fabricated from flat-rolled steel substrate precoated with an organic polymeric coating, such side wall defining an open end, such unitary endwall configuration being preselected in transverse relationship to such central axis, such that the unitary endwall configuration and such end closure means at such remaining longitudinal end coact to facilitate stable stacking of such containers with centrally-located axes vertically aligned.

4. The rigid container of claim 1, in which such container body means comprises a cup-shaped flat-rolled steel can body having an elongated side wall and a unitary bottom wall configuration at one longitudinal end of such side wall.

5. The rigid container body of claim 4, in which such can body side wall has a main body portion and a side wall portion located longitudinally opposite to such unitary bottom wall configuration, which is necked-in to provide for an end closure means having a cross section for interfitting in a stabilized stacking arrangement of hermetically-sealed containers with their centrally-located axes vertically aligned.

6. The rigid container of claim 1 for hermetically-sealing ground coffee, having an elongated sheet metal side wall having a side wall seam, a sheet metal end closure structure for each longitudinal end of the elongated side wall a necked-in side wall portion at one longitudinal end of the elongated side wall for receiving one of such end closure structures, with such remaining end closure structure having a configuration for receiving such end closure, located at such necked-in side wall portion, in a nested interfitting arrangement with central axes of stacked containers in linear alignment.

7. The container of claim 6, in which such elongated sheet metal side wall includes flange metal at each of its longitudinal ends for receiving a sheet metal end closure structure with flange metal for forming a chime seam, and in which such end closure structure for such necked-in side wall portion includes a separable plastic overcap for covering such end closure after opening such container by removing an endwall panel at such necked-in side wall end of such container body.

8. Method for producing a rigid container, which provides for selective separation of an emitted off-gas from solid particulate container contents while maintaining hermetic-sealing integrity of such contents and separated off-gas prior to opening the container, comprising (A) providing an elongated configuration rigid container body formed from flat-rolled sheet metal which is impervious to ambient atmosphere, such container body:

(i) defining a centrally-located axis for such rigid container, and (ii) having an elongated side wall symmetrically disposed in relation to such centrally-located axis for the container;

(B) providing end closure means formed from material impervious to ambient atmosphere so as to be capable, in combination with such container body, of forming a hermetically-sealed container for such contents;

(C) defining an enclosed chamber within such container by (D) providing an imperforate membrane film, which is permeable to a selected off-gas emitted by container contents, (E) positioning such film between such end closure means and such container body means in fixed transverse relationship to such centrally-located axis, with such film being intermediate such end closure means and such container contents so as to provide for receiving and retaining such off-gas while such container is hermetically-sealed.

9. The method of claim 8, in which such container body presents a necked-in side wall portion contiguous to one of its longitudinal ends, such necked-in side wall portion providing for receiving such end closure means for hermetically sealing such container.

10. The method of claim 9, including forming a threaded configuration at such necked-in longitudinal end side wall portion of the container body for receiving a screw cap end closure means.

11. The method of claim 9, including fabricating such container body means from flat-rolled steel to have flange metal at its necked-in longitudinal end, and including the step of providing sheet metal end closure means, for such necked-in longitudinal end, which includes flange metal for joining with such flange metal at such necked-in longitudinal end, for hermetic sealing of such container.

12. The method of claim 11, including forming such enclosed chamber in combination with an easy-open end closure means in a manner such that selected off-gas in such enclosed chamber is vented automatically prior to opening such hermetically-sealed container.

13. The method of claim 12, in which such easy-open end closure is provided with a peripherally located scoreline defining an endwall panel to be separated by action of an integral opener, a back scoreline located contiguous to a unitary rivet securing such opener to the endwall panel, and in which such back scoreline is ruptured initially to vent the enclosure chamber before opening of container.

14. Packaging procedure for solid particulate contents, which emit off-gases including carbon dioxide during storage, comprising the steps of providing a container body with a side wall defining a centrally-located axis for a container, such container body being fabricated from rigid packaging material which is impervious to ambient atmosphere and capable of withstanding an internal level of pressure selected from the group consisting of a vacuum level and an inert gas purging pressure level, for use in hermetically-sealed packaging of container contents;

providing an end closure structure, made from rigid flat-rolled sheet metal which is impervious to ambient atmosphere and capable of withstanding such a selected level of pressure and capable of combining with such container body to provide a hermetically-sealed container;

providing for an internal chamber space, within such a hermetically-sealed container, which can be separated from remaining space for container contents;

providing an imperforate membrane film which is permeable to carbon dioxide emitted by such container contents;

establishing such membrane film in fixed transverse relationship to such centrally-located axis separating such internal chamber space from remaining space for container contents, with such membrane film, in combination with such internal chamber space, forming an enclosed chamber for receiving and holding such emitted carbon dioxide after passage through such membrane so as to be held in separated relationship from such container contents; and hermetically-sealing such container including such enclosed chamber.

15. The procedure of claim 14, in which hermetic sealing of such container contents is carried out at a level of pressure selected from the group consisting of:

use of a vacuum level during hermetic sealing, use of an inert purge gas pressure level during hermetic sealing, and use of a level of pressure for such enclosed chamber which differs from the level of pressure for such remaining container space for contents during such hermetic sealing steps.

16. The procedure of claim 15, including augmenting separation of such emitted carbon dioxide from container contents, by selectively establishing, prior to hermetic sealing of the container, a level of pressure for such enclosed chamber which is lower than the level of pressure for such container contents in the remainder of such container.

17. The procedure of claim 14, including providing a sheet metal container body with an elongated side wall having flange metal at each of its longitudinal ends, providing a sheet metal end closure structure, for each such longitudinal end, having flange metal for forming a chime seam at each such longitudinal end of such side wall, forming one such end closure means to constitute the bottom wall configuration for such end closure, and necking-in a portion of such side wall for receiving such end closure opposite to such bottom wall configuration.

18. The procedure of claim 17, including fabricating such bottom wall configuration so as to receive such end closure at the necked-in longitudinal end of a container in nested stacking relationship.

19. The procedure of claim 14, including establishing a level of pressure for the enclosed chamber which augments separation of a selected off-gas emitted by container contents after such hermetic sealing step.

20. The procedure of claim 19, including providing for hermetically sealing the rigid container body, its particulate solid contents, and the enclosed chamber separated by such membrane film from the remainder of the container and its contents, utilizing structure selected from the group consisting of:

(a) a screw cap end closure structure for one longitudinal end of a one piece sheet metal can body, (b) a sheet metal container body with flange metal at each longitudinal end and a sheet metal end closure structure for each such end with flange metal for double-seam jointer with such container body flange metal, and (c) a sheet metal end closure with flange metal for joining with flange metal of a sheet metal can body at one longitudinal end of an elongated side wall, with a unitary bottom wall configuration at the remaining end of such side wall.

21. The procedure of claim 20, in which such end closure at such necked-in longitudinal end includes an enclosed chamber, for receiving such off-gas, defined on the product-side surface of such end closure by a lattice-type support framework for such gas-permeable membrane film.

* * * * *